US007160365B2

(12) United States Patent
Iwamatsu

(10) Patent No.: US 7,160,365 B2
(45) Date of Patent: Jan. 9, 2007

(54) ION GENERATING APPARATUS, AIR CONDITIONING APPARATUS, AND CHARGING APPARATUS

(75) Inventor: Tadashi Iwamatsu, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 366 days.

(21) Appl. No.: 10/795,406

(22) Filed: Mar. 9, 2004

(65) Prior Publication Data

US 2004/0201946 A1 Oct. 14, 2004

(30) Foreign Application Priority Data

Mar. 10, 2003 (JP) ..... 2003-063727

(51) Int. Cl.
*B03C 3/47* (2006.01)
*B03C 3/70* (2006.01)

(52) U.S. Cl. ..... 96/88; 95/59; 96/95; 96/99; 361/226; 361/233

(58) Field of Classification Search ..... 96/88, 96/95, 69, 99; 95/59; 361/226, 233; 55/DIG. 39
See application file for complete search history.

(56) References Cited

U.S. PATENT DOCUMENTS 2,740,184 A * 4/1956 Thomas ..... 442/194
4,155,093 A 5/1979 Fotland et al. ..... 347/127
4,391,773 A * 7/1983 Flanagan ..... 422/22
4,743,275 A * 5/1988 Flanagan ..... 95/28
4,874,659 A * 10/1989 Ando et al. ..... 428/221
4,944,778 A * 7/1990 Yanagawa ..... 96/66
4,978,372 A * 12/1990 Pick ..... 96/67
5,055,118 A * 10/1991 Nagoshi et al. ..... 96/88
5,084,078 A * 1/1992 Suzuki et al. ..... 96/52
5,348,571 A * 9/1994 Weber ..... 96/68
5,474,600 A * 12/1995 Volodina et al. ..... 96/57
5,582,632 A * 12/1996 Nohr et al. ..... 95/78
5,938,823 A * 8/1999 Condit et al. ..... 96/16

(Continued)

FOREIGN PATENT DOCUMENTS

JP H2-22998 B2 5/1990

(Continued)

OTHER PUBLICATIONS

Kellchi Nashimoto, Journal of Imaging Science (The Effect of Electrode Materials on $O_3$ and $No_x$ Emissions by Corona Discharging) vol. 32, No. 5, p. 205-210, 1988.

*Primary Examiner*—Richard L. Chiesa
(74) *Attorney, Agent, or Firm*—Birch, Stewart, Kolasch & Birch, LLP

(57) ABSTRACT

An ion generating apparatus is built by sandwiching a dielectric layer between an induction electrode and a discharge electrode. The induction electrode is formed of a metal substrate of, for example, aluminum. Even when the apparatus is made larger, it offers improved mechanical strength compared with a conventional structure employing a dielectric layer formed of a ceramic substrate, a brittle material. The dielectric layer is formed of a thin film having an insulation breakdown withstand voltage of 30 V/μm or more and having a thickness of 30 μm or less. The discharge electrode is formed on the dielectric layer such that the area occupied by the electrode portion of individual line-shaped electrodes is smaller than the area occupied by the non-electrode portion thereof. This helps to make the discharge voltage lower and to reduce the amount of ozone generated by electric discharge.

12 Claims, 11 Drawing Sheets

U.S. PATENT DOCUMENTS

| | | | | |
|---|---|---|---|---|
| 6,117,403 | A * | 9/2000 | Alix et al. | 423/210 |
| 6,245,126 | B1 * | 6/2001 | Feldman et al. | 95/59 |
| 6,749,669 | B1 * | 6/2004 | Griffiths et al. | 96/67 |
| 2005/0168907 | A1 * | 8/2005 | Sekoguchi et al. | 361/230 |

FOREIGN PATENT DOCUMENTS

| | | | | |
|---|---|---|---|---|
| JP | 4-161208 | * | 6/1992 | 96/99 |
| JP | 2002-95731 | A | 4/2002 | |

* cited by examiner

ION GENERATING APPARATUS, AIR CONDITIONING APPARATUS, AND CHARGING APPARATUS

This nonprovisional application claims priority under 35 U.S.C. § 119(a) on patent application Ser. No. 2003-63727 filed in Japan on Mar. 10, 2003, the entire contents of which are hereby incorporated by reference.

BACKGROUND OF THE INVENTION

1. Field of the Invention

The present invention relates to an ion generating apparatus that applies an alternating voltage between an induction electrode and a discharge electrode to cause corona discharge and thereby generates both positive and negative ions. The present invention relates also to an air conditioning apparatus and a charging apparatus provided with such an ion generating apparatus.

2. Description of the Prior Art

There is conventionally known a corona discharge element so structured that a dielectric layer is sandwiched between an induction electrode and a discharge electrode. An example of a so structured corona discharge element is disclosed, for example, in Japanese Patent Application Published No. H2-22998 (hereinafter referred to as Patent Reference 1). This corona discharge element is a surface corona discharge element composed of a 0.5 mm thick piece of alumna porcelain having a line-shaped discharge electrode of tungsten formed on one side thereof and having a surface-shaped induction electrode formed on the other side thereof This type of corona discharge element is used, for example, as an ozonizer.

In the manufacturing process of this corona discharge element, to form the tungsten discharge electrode on the alumina substrate, it is necessary to go through a step of high-temperature baking at 1,500° C. Moreover, to enable the corona discharge element to cause electric discharge, it is necessary to apply a voltage as high as 10 kVpp (peak-to-peak) at 10 kHz between the induction electrode and the discharge electrode. This necessitates special consideration for reliability and safety against human body contact and malfunctioning. Moreover, the high-voltage power supply by itself is not only expensive but highly power-consuming.

This corona discharge element operates with good ozone generation efficiency, and is therefore suitable for use as a ozonizer. It is difficult, however, to use it in an air purifier or charging apparatus because it generates too much ozone, which is hazardous to the human body.

There is also conventionally known an example in which a discharge element structured similarly to the one described above is applied in a charging apparatus. For example, U.S. Pat. No. 4,155,093 (hereinafter referred to as Patent Reference 2) discloses, as an example of such a discharge element, a discharge element composed of a piece of glass having line-shaped electrodes arranged on opposite sides thereof so as to cross each other. In this structure, electric discharge occurs and ions are generated selectively at the intersections between the line-shaped electrodes on one side and those on the opposite side. This makes it possible to form an electrostatic latent image directly on a cylindrical dielectric member placed so as to face the discharge element. By making this electrostatic latent image visible on the principle of electrophotography, it is possible to realize a printer, copier, facsimile machine, or the like.

There have also been conventionally made many proposals to use a discharge element not as a charging apparatus as described above but as a charger that discharges uniformly in the axial direction of the discharge element to charge a photoconductive member for electrophotography. Also in such applications in a charging apparatus or charger, however, as described above, it is necessary to go through a step of high-temperature baking in the manufacturing process, to use a high-voltage power supply, and to use an ozone-eliminating filter because of the large amount of ozone that the discharge element generates.

There have also been conventionally proposed discharge elements of a different type from the one described above. For example, Japanese Patent Application Laid-Open No. 2002-95731 (hereinafter referred to as Patent Reference 3) discloses a discharge element that uses a cylindrical glass tube as a dielectric layer and that is applied in an air conditioning apparatus so that positive ions $H^+(H_2O)_m$ (where m is a natural number) and negative ions $O_2^-(H_2O)_n$ (where n is a natural number) are generated by electric discharge and they are used to kill airborne bacteria floating in the atmosphere.

Also in this type of discharge element, since ions are generated on the principle of electric discharge, ozone is inevitably generated together. Since ozone is hazardous to the human body, its permissible concentration, i.e., safe level, is regulated as 0.1 ppm by Japan Society for Occupational Health. Accordingly, in the air conditioning apparatus mentioned above, to limit the amount of ozone generated below that safe level, there is provided an ozone concentration detecting sensor so that, according to the ozone concentration detected, a controller controls the voltage applied to the discharge element and other parameters. Here, the air conditioning apparatus requires the additional provision of the ozone concentration detecting sensor and the controller, and this increases the costs and size of the air conditioning apparatus.

Incidentally, as dealt with in an article included in "Journal of Imaging Science," Vol. 32, No. 5, pp. 205–210, September/October 1988 (hereinafter referred to as Non-Patent Reference 1), research has been being done on the relationship between the wire diameter of a wire electrode to which a high voltage is applied to cause corona discharge and the amount of ozone generated. This article shows that, in experiments conducted with wire electrodes of diameters of several ten μm to 150 μm, there is a linear relationship such that, the smaller the wire diameter, the smaller the amount of ozone generated. It is also shown that this tendency is observed similarly both in positive and negative corona but that the amount of ozone generated by positive corona is smaller by about one order of magnitude than that generated by negative corona. These discharge characteristics are the results of studying the characteristics of a discharge element used as the discharger of a copier, and therefore they are considered to suggest that the same quantity of ions for electric discharge can be generated with a reduced amount of ozone, which is hazardous to the human body.

However, in the structure disclosed in Patent Document 1 and described above, the dielectric layer sandwiched between the discharge electrode and the induction electrode is a ceramic substrate, such as one made of alumina porcelain. Since ceramic is a brittle material, inconveniently, the larger the size of the discharge element, the lower the mechanical rupture strength thereof Moreover, the conventional discharge element (ion generating apparatus) is so structured as to generate both positive and negative ions by applying a high voltage between the discharge electrode and the induction electrode.

Here, the application of the high voltage results in generating a large amount of ozone, which is hazardous to the human body, and therefore using such a discharge element in an air conditioning apparatus or charging apparatus is suspected of leading to a health hazard.

SUMMARY OF THE INVENTION

An object of the present invention is to provide an ion generating apparatus that, despite being so structured that a dielectric layer is sandwiched between an induction electrode and a discharge electrode, does not lose mechanical rupture strength even when made larger in size, and to provide an air conditioning apparatus and a charging apparatus provided with such an ion generating apparatus.

Another object of the present invention is to provide an ion generating apparatus that can easily be driven with a low voltage and, by using it, to reduce the amount of ozone generated by electric discharge and thereby realize an air conditioning apparatus and a charging apparatus that are friendly to the human body and to the environment.

To achieve the above objects, according to the present invention, an ion generating apparatus that includes a dielectric layer sandwiched between an induction electrode and a discharge electrode and that generates both positive and negative ions by applying an alternating voltage between the induction electrode and the discharge electrode to cause electric discharge is characterized in that the induction electrode is formed of a metal substrate.

In the above structure, of the two electrodes, namely the induction electrode and the discharge electrode, between which the dielectric layer is sandwiched, the induction electrode is formed of a metal substrate. This metal substrate is formed, for example, as a metal substrate (such as an aluminum substrate) thicker than the induction electrode. When an alternating voltage is applied between this induction electrode and the discharge electrode, corona discharge occurs in the vicinity of the discharge electrode, and both positive and negative ions are generated.

Here, since the induction electrode is formed of a metal substrate, even when the ion generating apparatus as a whole is made larger, it is possible to give it higher mechanical strength compared with the conventional structure employing a dielectric layer formed of a ceramic substrate, a brittle material. That is, it is possible to realize an ion generating apparatus that is resistant to external vibration and impact and that has a long life.

Moreover, since the induction electrode itself is formed of a metal substrate, it has both the function of improving or maintaining the mechanical strength of the ion generating apparatus and the function of achieving electric discharge between it and the discharge electrode. That is, forming the induction electrode out of a metal substrate does not spoil its primary function (the latter of the two functions mentioned just above). In this way, without using a separate substrate for reinforcing the discharge element, it is possible to realize at low cost an ion generating apparatus that has high mechanical strength.

Advisably, the dielectric layer is formed of a thin film having an insulation breakdown withstand voltage of 30 V/μm or more and having a thickness of 30 μm or less. This makes it possible to make the dielectric layer thinner than when it is formed, for example, as a layer of anodized aluminum, while simultaneously preventing the isolation breakdown of the dielectric layer. Making the dielectric layer thinner results in increasing the electric field strength in the external space at the surface of the ion generating apparatus during electric discharge, and thus helps to reduce the voltage that needs to be applied to the discharge electrode. In this way, it is possible to reduce the amount of ozone generated during electric discharge.

Advisably, the discharge electrode is formed as a plurality of line-shaped electrodes laid in stripes on the dielectric layer in such a way that, within a single pitch with which the line-shaped electrodes are laid one adjacent to the next, the area that is occupied by the electrode portion of the line-shaped electrode laid there is smaller than the area that is occupied by the non-electrode portion thereof. This makes it easier for the electric field to concentrate on each of the line-shaped electrodes than in the structure where, within a single pitch of the line-shaped electrodes, the electrode portion width and the non-electrode portion width are equal, and also helps to produce a stronger electric field. This makes it possible to achieve electric discharge easily even with a lower voltage applied to the discharge electrode. In this way, it is possible to reduce the discharge voltage and thereby reduce the amount of ozone generated during electric discharge.

By building an air conditioning apparatus and a charging apparatus by using an ion generating apparatus according to the present invention, it is possible to realize an air conditioning apparatus and a charging apparatus that are resistant to impact and the like and that have a long life. Moreover, with a reduced amount of ozone generated during electric discharge, it is possible to realize an air conditioning apparatus and a charging apparatus that are friendly to the human body and to the environment.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Hereinafter, an embodiment of the present invention will be described with reference to FIGS. 1 to 11.

1. Basic Structure of an Ion Generating Apparatus

Figure 1:
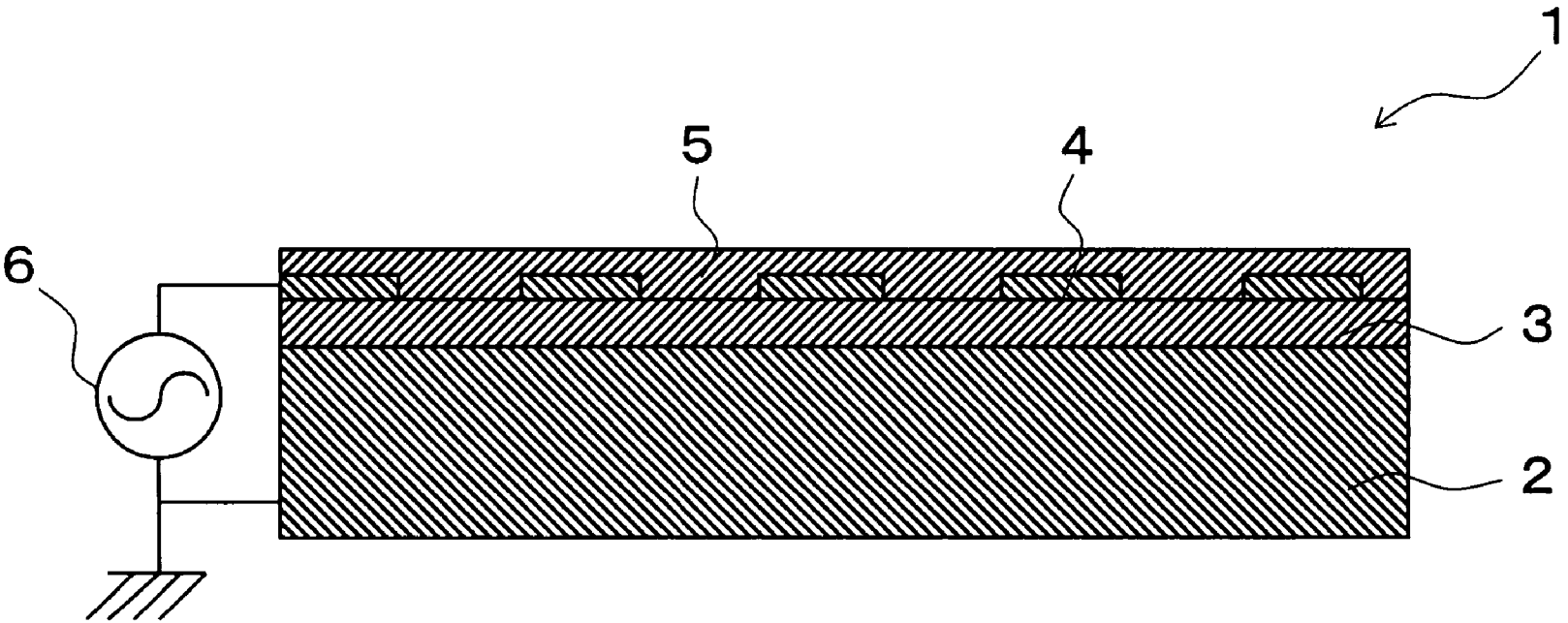
FIG. 1 is a diagram illustrating an outline of the structure of an ion generating apparatus embodying the invention.

FIG. 1 is a diagram illustrating an outline of the basic structure of an ion generating apparatus 1 as an example of a discharge element embodying the invention. As shown in this figure, the ion generating apparatus 1 of according to the invention includes an induction electrode 2, a dielectric layer 3, a discharge electrode 4, a surface coat layer 5, and a power supply 6.

The induction electrode 2 is formed of a metal substrate such as an aluminum substrate. Conventionally, the dielectric layer 3 is formed of a material having low mechanical strength, such as ceramic or glass, and in addition the induction electrode 2 is formed thin, with the result that the discharge element as a whole has low mechanical strength. By contrast, according to the invention, the induction electrode 2 is formed of a metal substrate, which has higher mechanical strength than ceramic or the like, and the induction electrode 2 is given both the function of reinforcing the discharge element and the function of achieving electric discharge. These are the distinctive features of the invention. The induction electrode 2 is, for example, so formed as to be thicker than the dielectric layer 3 so as to have satisfactorily high mechanical strength.

Here, the practical thickness of the induction electrode 2 is determined according to the mechanical strength needed. The mechanical strength needed depends on the load that is borne by the ion generating apparatus 1. For example, in a case where the ion generating apparatus 1 is supported like a beam supported at one end only, the mechanical strength needed increases in proportion to the cube of the thickness of the induction electrode 2. Hence, by giving the induction electrode 2 a thickness of 1 mm or more, it is possible to secure satisfactory mechanical strength.

The induction electrode 2 may be formed of any other material than aluminum, such as iron or stainless steel. Since iron or stainless steel has higher mechanical strength than aluminum, forming the induction electrode 2 out of such a metal material makes it possible to make the induction electrode 2 thinner. Although the induction electrode 2 is grounded in FIG. 1, it does not necessarily have to be grounded.

The dielectric layer 3 is formed on top of the induction electrode 2, and is sandwiched between the induction electrode 2 and the discharge electrode 4. In this embodiment, since the induction electrode 2 is formed of an aluminum substrate, the dielectric layer 3 is formed of an anodic oxide film of aluminum (a layer of anodized aluminum). The dielectric layer 3 is given a thickness of, for example, 20 to 30 μm.

The discharge electrode 4 is formed as a metal electrode such as a copper electrode, and is formed on top of the dielectric layer 3 by patterning. In this embodiment, the discharge electrode 4 is, for example, composed of a plurality of line-shaped electrodes that are laid in the shape of stripes on the dielectric layer 3. The discharge electrode 4 may be formed in the shape of a grid on the dielectric layer 3.

The surface coat layer 5 is formed on top of the dielectric layer 3 so as to cover the discharge electrode 4. The surface coat layer 5 is formed, for example, of a thin-film dielectric material such as a 15 μm or less thick oxide film (for example, silicon oxide film) or nitride film (for example, silicon nitride or aluminum nitride film), and serves to protect the discharge electrode 4.

The power supply 6 is for applying an alternating voltage (alternating-current voltage) between the induction electrode 2 and the discharge electrode 4. When the power supply 6 applies an alternating voltage between the induction electrode 2 and the discharge electrode 4, corona discharge occurs in the vicinity of the discharge electrode 4, and positive ions $H^+(H_2O)_m$ (where m is a natural number) and negative ions $O2^-(H_2O)_n$ (where n is a natural number) are generated from the vicinity of the discharge electrode 4.

The ion generating apparatus 1 of this embodiment is manufactured through the following process. First, an aluminum substrate is prepared as the induction electrode 2, and it is then subjected to electrochemical oxidization with the metal substrate itself used as the node so that, on its surface, an anodic oxide film having a film thickness of 20 to 30 μm is formed as the dielectric layer 3. Next, by electroless plating, a pattern of copper in the shape of stripes is formed as the discharge electrode 4 on top of the dielectric layer 3. This electrode may be formed of any other material than copper, such as nickel or cobalt, so long as it is suitable for electroless plating. Then, by sputtering, an $SiO_2$ thin film is formed as the surface coat layer 5 on top of the dielectric layer 3 so as to cover the discharge electrode 4. Then, lastly, the power supply 6 is electrically connected to the induction electrode 2 and to the discharge electrode 4. Now, the ion generating apparatus 1 is in its completed form.

As described above, the ion generating apparatus 1 according to the invention is an ion generating apparatus 1 that generates both positive and negative ions by applying, from a power supply 6, an alternating voltage between an induction electrode 2 and a discharge electrode 4 sandwiching a dielectric layer 3, wherein the induction electrode 2 is formed of a metal substrate. With this structure, even when the ion generating apparatus 1 as a whole is made larger, it is possible to give it higher mechanical strength as a whole than with the conventional structure employing a dielectric layer formed of a brittle material such as ceramic.

Moreover, according to the invention, the induction electrode 2 itself is formed of a metal substrate, and thus the induction electrode 2 is given both the function of increasing the mechanical strength of the ion generating apparatus 1 and the function of serving as an electrode for achieving electric discharge between it and the discharge electrode 4. Thus, without using a separate substrate for reinforcing the ion generating apparatus 1, it is possible to give the ion generating apparatus 1 increased mechanical strength, and thus it is possible to realize at low cost an ion generating apparatus 1 that has high mechanical strength.

Moreover, according to the invention, the metal substrate used as the induction electrode 2 of the ion generating apparatus 1 is made of aluminum, and the dielectric layer 3 is formed of an anodic oxide film of the aluminum. Since the metal substrate is made of aluminum, the dielectric layer 3 can be formed easily on the surface of the induction electrode 2 by a simple method called anodic oxidization Moreover, according to the invention, since a metal substrate such as an aluminum substrate is used as the induction electrode 2, the discharge electrode 4 cannot be formed by high-temperature baking. However, according to the invention, the discharge electrode 4 is formed as a metal electrode containing at least one metal selected from nickel, copper, and cobalt, and therefore the discharge electrode 4 can be formed by electroless plating. In other words, according to the invention, the discharge electrode 4 can be formed without high-temperature baking.

Moreover, the ion generating apparatus 1 according to the invention is provided with the surface coat layer 5 that is formed on top of the dielectric layer 3 so as to cover the discharge electrode 4. In the vicinity of the surface of the discharge electrode 4, a strong electric field is formed, and corona discharge is taking place. Thus, in that vicinity, there exist positive ions, negative ions, and electrons generated as a result of the ionization of gas molecules. This charged particles acquire high kinetic energy from the strong electric field, and when those of the particles which are accelerated in the direction toward the ion generating apparatus 1 collide with the surface of the discharge element such as the discharge electrode 4, the discharge element is destroyed by ion bombardment (sputtering). By providing the surface coat layer 5 described above, however, it is possible to prevent the above-described sputtering-induced destruction of the surface of the discharge element such as the discharge electrode 4, and thus the destruction of the ion generating apparatus 1.

Moreover, although nickel, copper, or cobalt used as the material of the discharge electrode 4 is less resistant to sputtering than the conventional material for the discharge electrode, by forming the surface coat layer 5 so also to cover the discharge electrode 4, it is possible to overcome that shortcoming.

Moreover, the surface coat layer 5 is formed of a thin-film dielectric material having a film thickness of 15 μm or less. This helps to minimize the degradation of the electric field in the later-described air layer in the external space. Moreover, the surface coat layer 5 is formed of an oxide film or nitride film. Thus, the surface coat layer 5, even with a film thickness of 15 μm or less, is satisfactorily resistant to sputtering.

2. Ozone Reduction Analysis

Now, a description will be given of an analysis carried out to know how to reduce the amount of ozone generated as electric discharge takes place in the ion generating apparatus 1.

Analyzing the study, included in Non-Patent Reference 1 mentioned earlier, of the discharge electric field of a wire electrode leads to a conclusion that, the smaller the wire diameter, the more the strong electric field region needed for electric discharge concentrates around the wire. That is, it can be said that, the more the electric field concentrates, and thus the smaller the volume of the strong electric field space, the smaller the amount of ozone generated. The reason is considered to be that the energy that ionizes air and thereby generates ions is higher than the energy that generates ozone, and in addition that the generated ozone is readily decomposed in the strong electric field region, where ions are actively generated.

Thus, it is now found that it is possible to reduce the amount of ozone generated while maintaining a fixed quantity of ions generated by designing the ion generating apparatus 1 in such a way as to reduce the volume of the strong electric field space produced as a result of the concentration of the electric field. On the other hand, reducing the discharge voltage and the discharge current also contributes to the reduction of ozone generated.

Now, how the amount of ozone generated can be reduced in the ion generating apparatus 1 structured as described above by concentrating the electric field in the discharge portion through the optimization of the shape of the discharge electrode 4 and through the thinning of the dielectric layer 3 will be described specifically on the basis of the theoretical analysis and experiment results presented below.

2-1. Theory for Electric Field Analysis in the Ion Generating Apparatus

Figure 2:
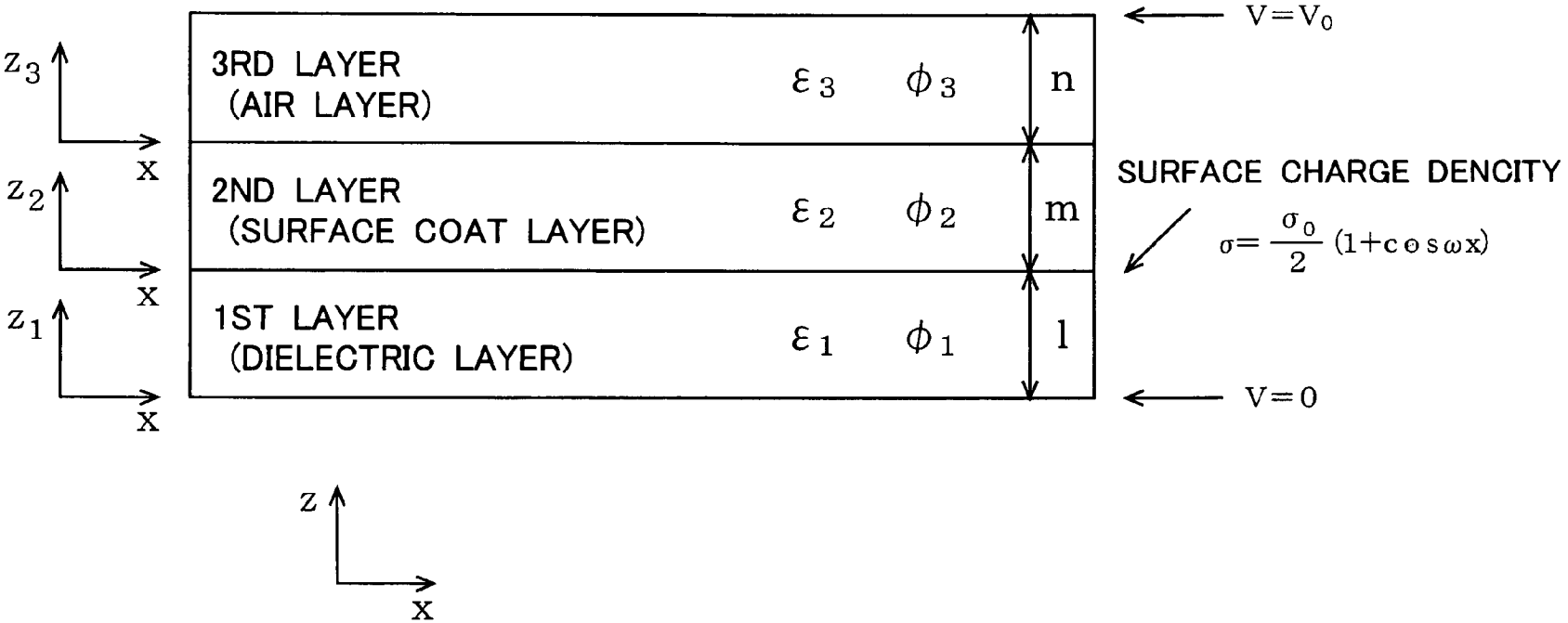
FIG. 2 is diagram illustrating the electric field analysis model inside the above-mentioned ion generating apparatus and in the external space outside it.

FIG. 2 is a diagram illustrating the electric field analysis model inside the ion generating apparatus 1 and in the external space outside it. The first layer corresponds to the dielectric layer 3 formed on the surface of the induction electrode 2. This dielectric layer 3 has a layer thickness of 1 [μm], a relative dielectric constant of $\epsilon_a$, and a potential function $\phi_1$. The second layer corresponds to the surface coat layer 5 formed at the outermost surface of the ion generating apparatus 1. This surface coat layer 5 has a layer thickness of m [μm], a relative dielectric constant of $\epsilon_b$, and a potential function $\phi_2$. The third layer corresponds to an air layer in the external space. This air layer has a layer thickness of n [μm], a relative dielectric constant of $\epsilon_c$, and a potential function $\phi_3$. Here, assuming that $\epsilon_0$ represents the dialectic constant of vacuum ($8.85\times10^{-12}$ [F/m]), and that the dielectric constants of the dielectric layer 3, the surface coat layer 5, and the air layer are $\epsilon_1$, $\epsilon_2$, and $\epsilon_3$ respectively, then $\epsilon_1=\epsilon_0\times\epsilon_a$, $\epsilon_2=\epsilon_0\times\epsilon_b$, and $\epsilon_3=\epsilon_0\times\epsilon_c$.

At the bottom of the dielectric layer 3, there lies a conductive substrate that functions as the induction electrode 2, and the potential at this conductive substrate is assumed to be 0 [V]. The potential at the uppermost level of the air layer is assumed to be $V_0$ [V]. In reality, at the interface between the surface of the dielectric layer 3 and the surface coat layer 5 lies the discharge electrode 4 formed by patterning, with a voltage applied thereto. The electric charge density distribution on this discharge electrode 4 is assumed to be a sinusoidal electric charge density distribution a expressed by equations (1) below.

$$\sigma = \frac{\sigma_0}{2}(1+\cos\omega x), \quad \omega = \frac{2\pi}{\lambda} \tag{1}$$

This sinusoidal electric charge density distribution σ has a pattern of equally spaced lines such that the electric charge density varies periodically between 0 to $\sigma_0$ along the x-axis direction and remains uniform along the y-axis direction, which is perpendicular to the plane of the figure. Assuming that the direction in which the individual layers are laid on one another is the z-axis direction, the x-axis direction mentioned above is, within a plane perpendicular to the z-axis direction, the direction in which the line-shaped electrodes are laid one next to the other (one adjacent to the other), and the y-axis direction is, within the same plane, the direction perpendicular to the x-axis direction. The symbol ω represents, as shown by equations (1), a spatial frequency defined as the reciprocal of the electrode period (the pitch between two mutually adjacent line-shaped electrodes) λ [mm].

Since the analysis model is a two-dimensional model extending in the x-axis and z-axis directions as shown in FIG. 2, the electric fields in the dielectric layer 3, in the surface coat layer 5, and in the external space air layer are expressed respectively by two-dimensional Laplace equations (2) below. Here, to simplify the equations, the z-axis direction is considered within each of the local coordinate systems (with the z1, z2, and z3 axes) having their origins at different interfaces between the individual layers.

$$\frac{\partial^2\phi_1}{\partial x^2}+\frac{\partial^2\phi_1}{\partial z_1^2}=0 \tag{2}$$

$$\frac{\partial^2\phi_2}{\partial x^2}+\frac{\partial^2\phi_2}{\partial z_2^2}=0$$

$$\frac{\partial^2\phi_3}{\partial x^2}+\frac{\partial^2\phi_3}{\partial z_3^2}=0$$

The potential functions $\phi_1$, $\phi_2$, and $\phi_3$ of the individual layers are defined as linear combinations of AC and DC components as expressed by equations (3) below.

$$\phi_1=\phi_{1ac}+\phi_{1dc}$$

$$\phi_2=\phi_{2ac}+\phi_{2dc}$$

$$\phi_3=\phi_{3ac}+\phi_{3dc} \tag{3}$$

The analytical solutions to these potential functions $\phi_1$, $\phi_2$, and $\phi_3$ are obtained as general solutions expressed by equations (4) and (5) below.

$$\phi_{1ac}[x,z_1]=\{a_1\cdot e^{\omega z1}+b_1\cdot e^{-\omega z1}\}\cos(\omega x)$$

$$\phi_{2ac}[x,z_2]=\{a_2\cdot e^{\omega z2}+b_2\cdot e^{-\omega z2}\}\cos(\omega x)$$

$$\phi_{3ac}[x,z_3]=\{a_3\cdot e^{\omega z3}+b_3\cdot e^{-\omega z3}\}\cos(\omega x) \tag{4}$$

$$\phi_{1dc}[z_1]=c_1z_1+d_1$$

$$\phi_{2dc}[z_2]=c_2z_2+d_2$$

$$\phi_{3dc}[z_3]=c_3z_3+d_3 \tag{5}$$

By introducing as boundary conditions the continuity of the potential and the continuity of the electric flux density, it is possible to find the coefficients in the general solutions noted above and thereby derive the potential functions $\phi_1$, $\phi_2$, and $\phi_3$ of the individual layers.

The boundary conditions for the continuity of the potential with respect to the AC component are given by equations (6) below.

$$\phi_{1ac}[x,0]=0$$

$$\phi_{1ac}[x,l]=\phi_{2ac}[x,0]$$

$$\phi_{2ac}[x,m]=\phi_{3ac}[x,0]$$

$$\phi_{3ac}[x,n]=0 \tag{6}$$

The boundary conditions for the continuity of the electric flux density with respect to the AC component are given by equations (7) below.

$$\varepsilon_2\frac{-\partial\phi_{2ac}}{\partial z_2}\bigg|_{z_2=0}-\varepsilon_1\frac{-\partial\phi_{1ac}}{\partial z_1}\bigg|_{z_1=l}=\frac{1}{2}\sigma_0\cos(\omega x) \tag{7}$$

-continued $$\varepsilon_3\frac{-\partial\phi_{3ac}}{\partial z_3}\bigg|_{z_3=0}-\varepsilon_2\frac{-\partial\phi_{2ac}}{\partial z_2}\bigg|_{z_2=m}=0$$

By substituting the boundary conditions given by equations (6) and (7) in equations (4), it is possible to derive the potential functions $\phi_1$, $\phi_2$, and $\phi_3$ of the individual layers. For example, the AC component of the potential function $\phi_3$ of the third layer, i.e., the external space air layer, is derived as expressed by equation (8) below.

$$\phi_{3ac}=\frac{\dfrac{\sigma_0}{2\varepsilon_1\varepsilon_3\omega}\cos(x\omega)\mathrm{sech}(m\omega)\mathrm{sech}(n\omega)\sinh\{(n-z_3)\omega\}\tanh(l\omega)}{\dfrac{\tanh(l\omega)}{\varepsilon_1}+\dfrac{\tanh(m\omega)}{\varepsilon_2}+\dfrac{\tanh(n\omega)}{\varepsilon_3}+\dfrac{\varepsilon_2\tanh(l\omega)\tanh(m\omega)\tanh(n\omega)}{\varepsilon_1\varepsilon_3}} \tag{8}$$

Likewise, the DC component of the potential function $\phi_3$ of the third layer, i.e., the external space air layer, is derived as expressed by equation (9) below.

$$\phi_{3dc}=\frac{\dfrac{\sigma_0}{2\varepsilon_1\varepsilon_3}l(n-z_3)}{\dfrac{l}{\varepsilon_1}+\dfrac{m}{\varepsilon_2}+\dfrac{n}{\varepsilon_3}} \tag{9}$$

2-2 Example of Results of the Electric Field Analysis

Next, on the basis of the analytical solutions noted above, an analysis will be carried out on the electric field characteristics in the external space air layer at the surface of the discharge element. Table 1 shows the standard values of the variables used in the electric field analysis.

TABLE 1

| | | |
|---|---|---|
| Dielectric Layer Thickness | l | 450 μm |
| Dielectric Layer Dielectric Constant | $\epsilon_1$ | 9.34 |
| Surface Coat Layer Thickness | m | 15 μm |
| Surface Coat Layer Dielectric Constant | $\epsilon_2$ | 9.34 |
| External Air Layer Thickness | n | 100 mm |
| External Air Layer Dielectric Constant | $\epsilon_3$ | 1 |
| Electrode Period | λ | 1 mm |
| Induction Electrode Substrate Potential | $V_0$ | 0 |
| Maximum Discharge Electrode Potential | $V_{ch}$ | 2,300 V |

Now, the standard value of the amplitude $\sigma_0$ of the sinusoidal electric charge density distribution σ will be found. This amplitude $\sigma_0$ corresponds to the potential of the discharge electrode 4. First, in a manner similar to the one described above in which the potential function $\phi_3$ was derived, the potential function $\phi_2$ of the surface coat layer 5 is derived. By substituting the values in Table 1 in the potential function $\phi_2$, the potential function $\phi_2$ is reduced to a function with respect to x, $z_2$, and $\sigma_0$. Equations (1) dictate that the value of the σ is at its maximum at the origin, where x=0 and $z_2$=0, and therefore, by solving equation (10) below, it is possible to calculate the amplitude $\sigma_0$ of the electric charge density of the discharge electrode 4. The thus calculated amplitude $\sigma_0$ is 654 [μC/m$^2$].

$$\phi_2[0,0]=2300 \tag{10}$$

By substituting the standard values shown in Table 1 and the value of the amplitude $\sigma_0$ in the analytical solutions derived as described earlier, it is possible to calculate, in a simplified manner, the electric field inside and outside the discharge device under varying conditions.

Figure 3:
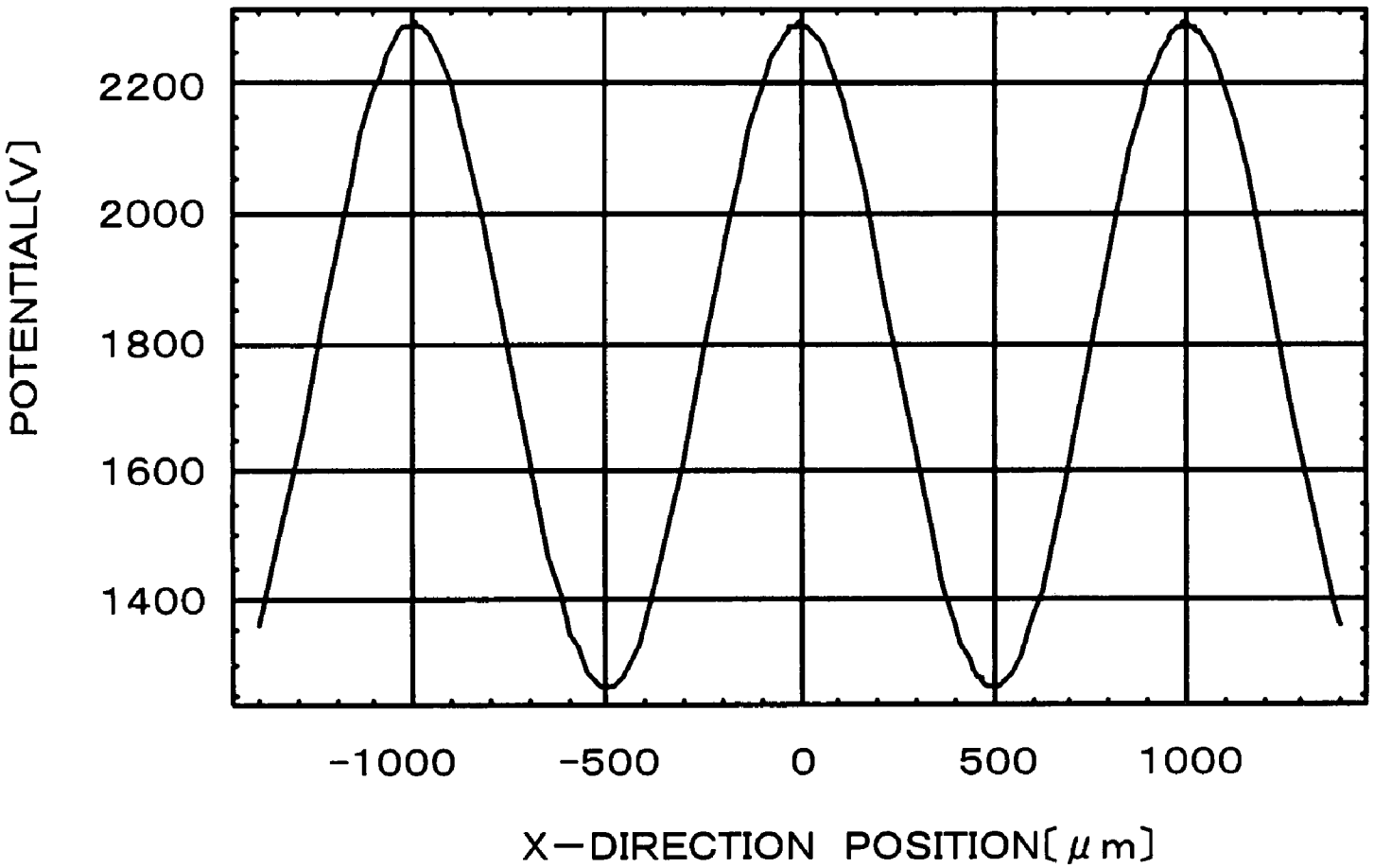
FIG. 3 is a diagram illustrating the potential distribution in the x-axis direction on the boundary surface of the discharge electrode of the above-mentioned ion generating apparatus.

As an example of such calculation, FIG. 3 shows the results of calculating the x-axis direction potential distribution at the interface of the discharge electrode 4 (the interface between the dielectric layer 3 and the surface coat layer 5). This figure shows the state in which a voltage of 2,300 V is applied to line-shaped electrodes that are laid with a period of 1 mm. In an experiment where the layer thickness was 15 μm as shown in Table 1, the potential distribution at the surface of the surface coat layer 5 was almost the same as that shown in FIG. 3.

Here, the distance between the induction electrode 2 and the discharge electrode 4 is 450 μm as shown in Table 1, and therefore, even at the position where the electric charge density is 0 between two adjacent line-shaped electrode where the electric charge density varies periodically, there exits a comparatively high potential over 1,200 V. Moreover, since the electric charge density distribution of the discharge electrode 4 is assumed to be a sinusoidal electric charge density distribution σ, the potential likewise shows a sinusoidal distribution with a duty factor (the proportion of the electrode portion width in the electrode period) of 50%. Although the actual potential distribution on the discharge electrode 4 may be rectangular, or may have varying duty factors, it is even then possible to grasp its qualitative tendency through the above-described calculation using the sinusoidal electric charge density distribution σ. Even a rectangular potential distribution with an arbitrary duty factor can be analyzed through the later-described calculation using a Fourier series.

Figure 4:
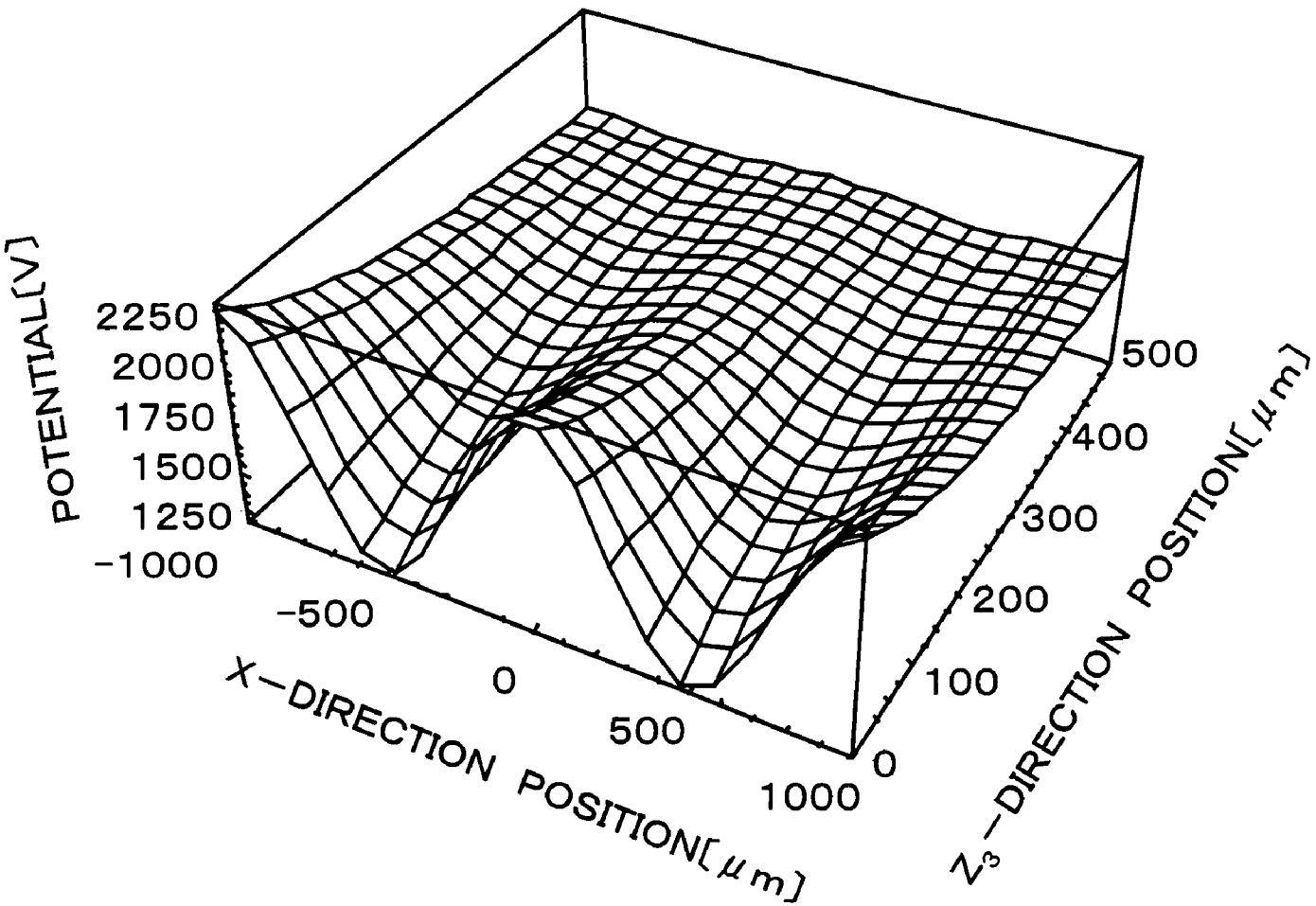
FIG. 4 is a diagram illustrating the results obtained by three-dimensionally plotting the potential distribution in the air layer in the external space outside the above-mentioned ion generating apparatus, as observed when the above-mentioned discharge electrode has a duty factor of 50%.

FIG. 4 shows the results of three-dimensionally plotting the potential distribution of the external space air layer under the above analysis conditions. In the vicinity (where $z_3$ approaches 0) of the surface of the ion generating apparatus 1, the potential varies greatly; the farther away from the surface of the apparatus, however, the smaller the variation of the potential. Since the magnitude of the variation of the potential is the magnitude of the electric field strength, the results show that the electric feed strength is high in the vicinity of the surface of the apparatus and that electric discharge occurs there.

Incidentally, an electric field strength function E is found by finding the gradient of a potential function φ. For example, the electric field strength function $E_3$ of the external space air layer is given by equation (11) below. Here, since the analysis model is two-dimensional, the differential operator (grad) for finding the gradient is two-dimensional, and the electric field strength function $E_3$ is a two-dimensional vector.

$$\begin{aligned} E_3 &= E_{3ac} + E_{3dc} \\ &= -grad(\phi_{3ac}) - grad(\phi_{3dc}) \end{aligned} \tag{11}$$

Then, by finding the inner product norm of this electric field strength function (vector) E, it is possible to calculate the magnitude (scalar) $E_{nrm}$ of the electric field strength at an arbitrary position. For example, the magnitude $E_{nrm}$ of the electric field strength in the external space air layer is given by equation (12) below.

$$E_{nrm3}=\sqrt{\langle E_3,E_3\rangle} \tag{12}$$

Figure 5:
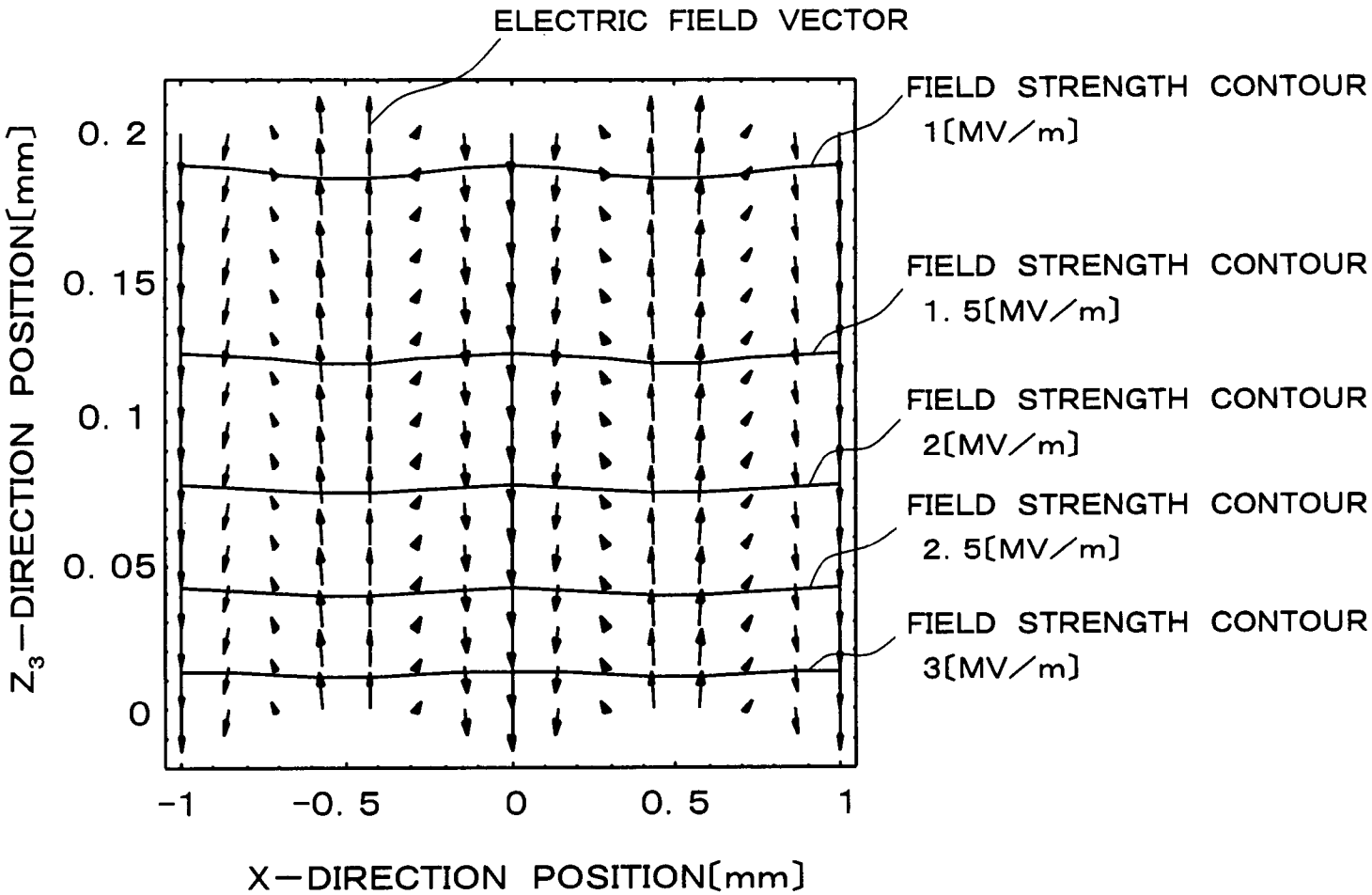
FIG. 5 is a diagram illustrating the state of the electric field in the above-mentioned external space air layer.

FIG. 5 shows the results of calculating the state of the electric field in the external space air layer in the vicinity of the surface of the ion generating apparatus 1 as obtained by the analysis method described above. In FIG. 5, the electric field vectors calculated according to equation (11) are indicated by arrows, and different magnitudes of the electric field strength calculated according to equation (12) are indicated by electric field strength contour lines. The results show that, the closer to the surface of the apparatus (the surface of the surface coat layer 5), the higher the electric field strength, and that, in the vicinity of the surface of the apparatus, there appears a magnitude of electric field strength equal to that (3 [MV/m]) which is generally know as the insulation breakdown withstand voltage (discharge start voltage) of discharge air.

In the foregoing description, the electric charge density distribution on the discharge electrode 4 is assumed to be a sinusoidal electric charge density distribution a, and therefore the electric field strength remains substantially uniform along the x-axis direction. That is, the electric field strength contour lines run substantially straight and parallel to the surface of the apparatus. However, the actual potential distribution on the discharge electrode 4 is a rectangular potential distribution with an arbitrary duty factor, and thus the electric field concentrates at the electrode edges, resulting in a non-uniform electric field distribution along the x-axis direction. Now, a description will be given of how to analyze such a rectangular potential distribution with an arbitrary duty factor.

2-3 Arbitrary Electrode Analysis Theory Using a Fourier Series

To calculate the electric field of the discharge electrode 4 having line-shaped electrodes formed with an arbitrary duty factor, the following function is introduced: the periodic function G(θ) of a rectangular wave with a period of 2π, a width of 2α, and a height of 1. This function is expressed, by the use of a Fourier series, by equation (13) below.

$$G(\theta) = \frac{\alpha}{\pi} + \frac{2}{\pi}\sum_{n=1}^{\infty}\frac{\sin(n\cdot\alpha)}{n}\cos(n\cdot\theta) \tag{13}$$

Here, if it is assumed that the electrode period λ of the discharge electrode 4 equals the sum of the electrode portion width $X_W$ and non-electrode portion width $X_b$ of the line-shaped electrodes, the variables α and θ in equation (13) are expressed by equations (14) below.

$$\begin{aligned} \alpha &= \frac{X_w}{X_w + X_b}\pi \\ \theta &= \omega x \\ \omega &= \frac{2\pi}{X_w + X_b} \end{aligned} \tag{14}$$

Substituting equations (14) in equation (13) permits the arbitrary duty rectangular periodic function G to be rearranged as a function with respect to x as expressed by equation (15) below.

$$G(x) = \frac{X_w}{X_w + X_b} + \frac{2}{\pi}\sum_{n=1}^{\infty}\frac{\sin\left(\pi n \frac{X_w}{X_w + X_b}\right)}{n}\cos\left(2\pi n \frac{x}{X_w + X_b}\right) \tag{15}$$

The frequency response of the potential amplitude with respect to the electrode period ω is expressed by the use of an MTF function (modified transfer function). For example, the MTF function of the external space air layer is, assuming that the values at positions where x=0 are representative, expressed by equation (16) below.

$$MTF = \frac{\phi_{3ac}}{\underset{\omega\to 0}{\text{Limit}}\,\phi_{3ac}} = \frac{\frac{1}{\omega l(n - z_3)}\left(\frac{l}{\varepsilon_1} + \frac{m}{\varepsilon_2} + \frac{n}{\varepsilon_3}\right)}{\frac{\tanh(l\omega)}{\varepsilon_1} + \frac{\tanh(m\omega)}{\varepsilon_2} + \frac{\tanh(n\omega)}{\varepsilon_3} + \frac{\varepsilon_2\tanh(l\omega)\tanh(m\omega)\tanh(n\omega)}{\varepsilon_1\varepsilon_3}} \tag{16}$$

By multiplying the high-order components of the arbitrary duty rectangular periodic function G(x) expressed by the use of a Fourier series as shown by equation (15) by the MTF function (equation (16)) corresponding to the spatial frequency, a response function RF given by equation (17) below is obtained. Since the rectangular periodic function G and the MTF function are normalized (with an amplitude of 1), this response function RF is a normalized function.

$$RF(x, z_3) = \frac{X_w}{X_w + X_b} + \frac{2}{\pi}\sum_{n=1}^{\infty} MTF\frac{\sin\left(\pi n \frac{X_w}{X_w + X_b}\right)}{n}\cos\left(2\pi n \frac{x}{X_w + X_b}\right) \tag{17}$$

Accordingly, the actual potential profile $V_{prf}$ is found, as shown by equation (18) below, by multiplying the response function RF by the maximum discharge electrode potential $V_{ch}$ shown in Table 1 as the potential amplitude.

$$V_{prf}=V_{ch}\cdot RF \tag{18}$$

Figure 6:
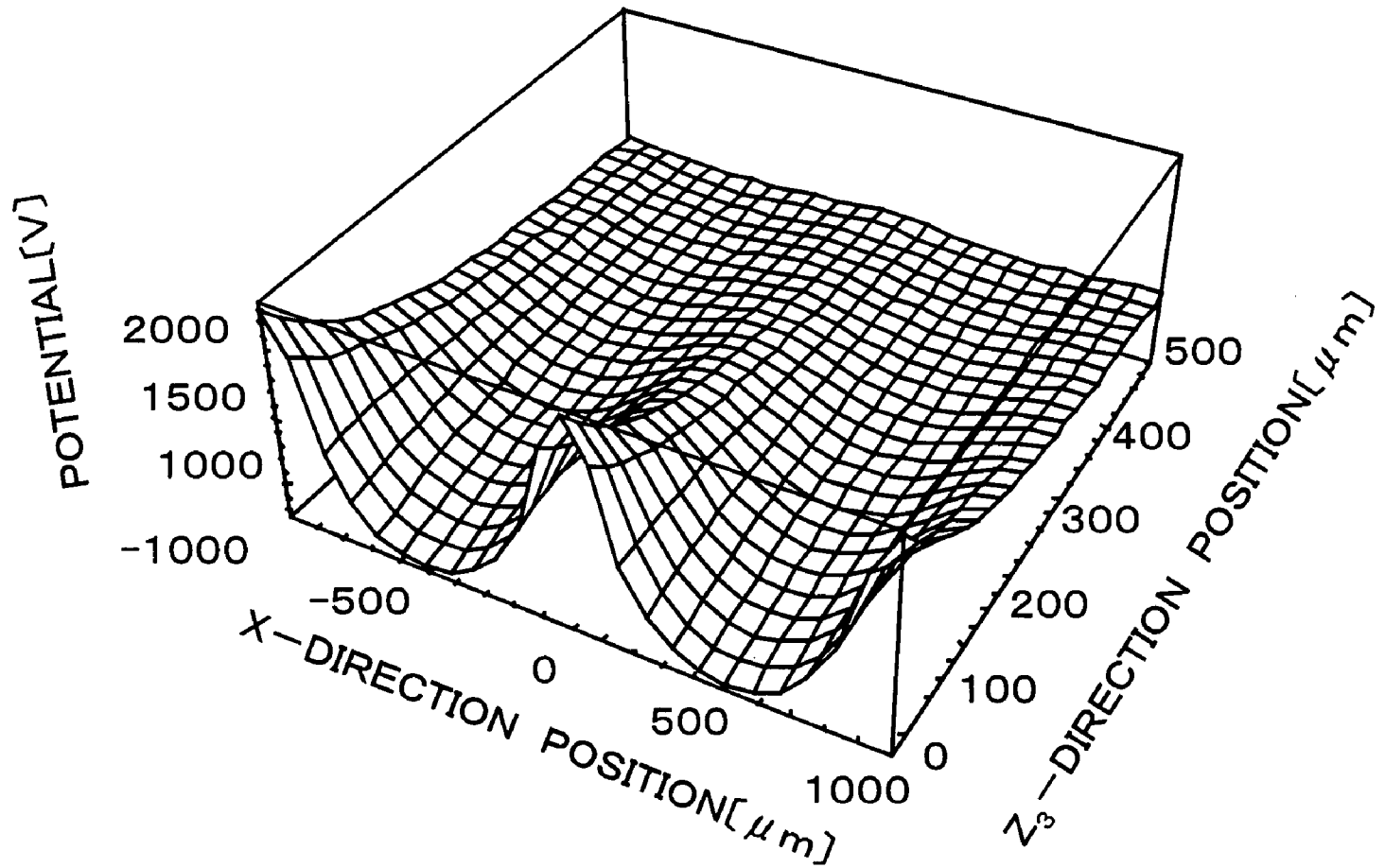
FIG. 6 is a diagram illustrating the results obtained by three-dimensionally plotting the potential distribution in the above-mentioned external space air layer, as observed when the above-mentioned discharge electrode is has a duty factor of 20%.
Figure 7:
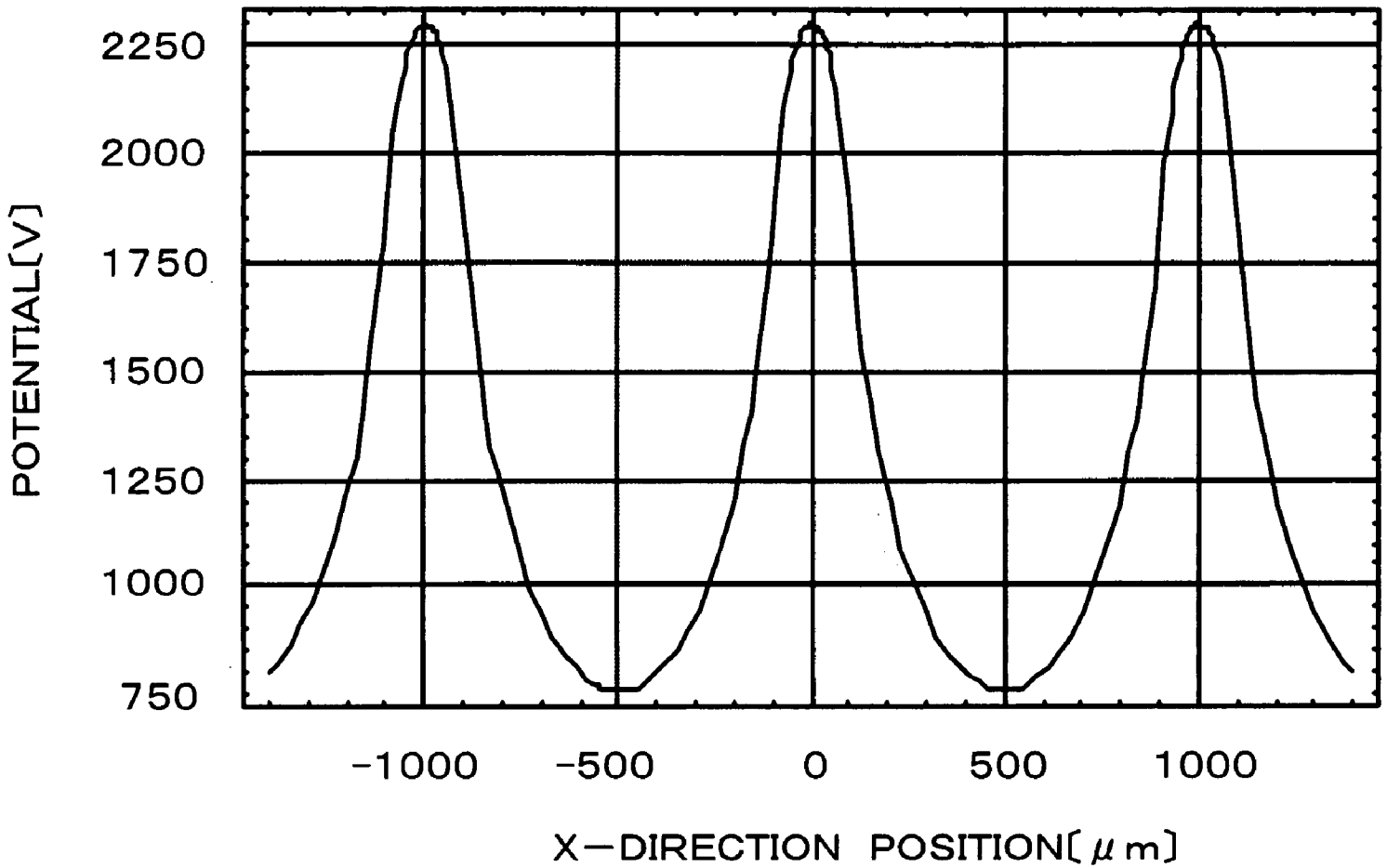
FIG. 7 is a diagram illustrating the potential distribution in the x-axis direction on the surface of the above-mentioned ion generating apparatus under the above-mentioned conditions.

FIG. 6 shows the results of three-dimensionally plotting the potential distribution in the external space air layer as obtained by the analysis method described above, assuming that the discharge electrode 4 has a duty factor of 20% (with an electrode period of 1 mm, an electrode portion width of 200 μm, and a non-electrode portion width of 800 μm). FIG. 7 shows the results of two-dimensionally plotting the potential distribution on the surface of the ion generating apparatus 1, i.e., at positions where z=0. This figure shows that the potential varies more greatly in the vicinity of the surface of the ion generating apparatus 1 than elsewhere.

Moreover, comparing FIG. 3 and FIG. 7 shows that making the electrode portion width smaller relative to the electrode period results in lowering the potential between the electrode portions. This makes the potential gradient steeper, and thus makes it possible to obtain a higher electric field strength by the application of the same voltage. To more quantitatively grasp the magnitude of the electric field strength, next, an electric field strength function $E_m$ is derived in the following manner with respect to the external space air layer.

In a case where the discharge electrode pattern has an arbitrary duty factor as described above, the electric field strength function $E_m$ of the external space air layer can be found by finding the gradient of the above-mentioned potential profile function $V_{prf}$ as expressed by equation (19) below. Here, the external space air layer is sufficiently thick, specifically z=100 mm, and therefore the DC component of the electric field strength is so minute as to be negligible. Moreover, since the analysis model is two-dimensional, the differential operator (grad) for finding the gradient is two-dimensional, and the electric field strength function $E_m$ is a two-dimensional vector.

$$E_m=-\text{grad}(V_{prf}) \tag{19}$$

Then, by finding the inner product norm of this electric field strength function (vector) $E_m$, it is possible to calculate the magnitude (scalar) $E_{mnrm}$ of the electric field strength at an arbitrary position. Hence, the magnitude $E_{mnrm}$ of the electric field strength in the external space air layer is given by equation (20) below.

$$E_{mnrm}=\sqrt{\langle E_m E_m\rangle} \tag{20}$$

Figure 8:
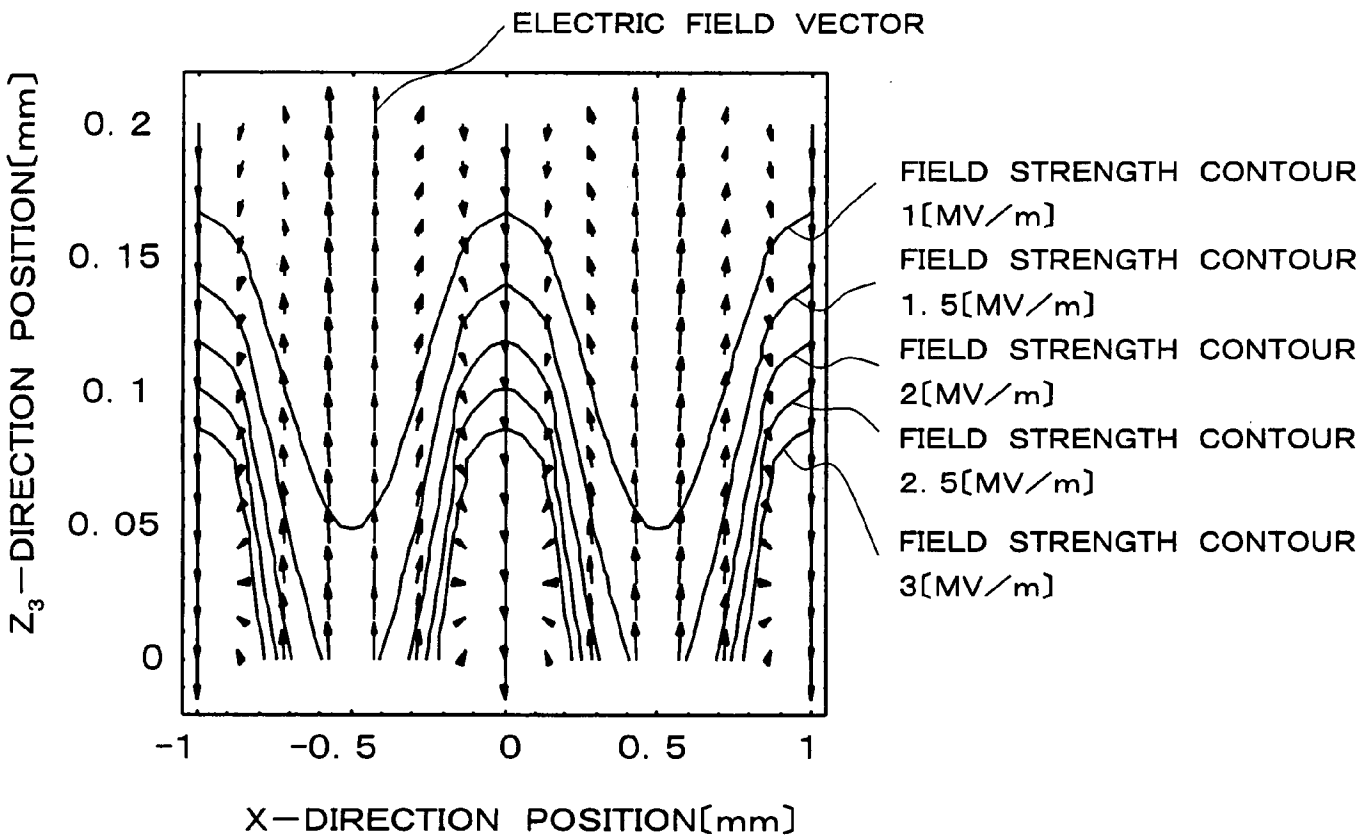
FIG. 8 is a diagram illustrating the state of the electric field in the above-mentioned external space air layer under the above-mentioned conditions.

FIG. 8 shows the results of calculating the state of the electric field in the external space air layer in the vicinity of the surface of the ion generating apparatus 1 as obtained by the analysis method described above. In FIG. 8, the electric field vectors calculated according to equation (19) are indicated by arrows, and different magnitudes of the electric field strength calculated according to equation (20) are indicated by electric field strength contour lines. The results show that the electric field is strong in regions where the electrode portions of the discharge electrode 4 are located, i.e., where x=±0.1 mm (with a width of 200 μm).

Moreover, comparing FIG. 5 and FIG. 8 shows, more quantitatively, that making the electrode portion width smaller relative to the electrode period causes the electric field to concentrate in the vicinity of the line-shaped electrodes of the discharge electrode 4, and thus makes it possible to obtain a higher electric field strength by the application of the same voltage. Whereas under the analysis conditions of FIG. 5 the duty factor of 50% results in a low electric field strength, under the analysis conditions of FIG. 8 the duty factor of 20% causes the concentration of the electric field and thus yields a higher electric field strength. That is, it can be said that, by making the area of the electrode portion of the discharge electrode 4 smaller than the area of the non-electrode portion thereof, it is possible to cause the concentration of the electric field more effectively and thereby obtain a higher electric field strength. By concentrating the electric field and thereby increasing the electric field strength, it is possible to doubly achieve the reduction of the amount of ozone generated, i.e., both through the concentration of the electric field and through the reduction of the discharge voltage.

Moreover, the analysis results shown in FIG. 8 show that, in the vicinity of the discharge electrode 4, there appears a magnitude of electric field strength higher than that (3 [MV/m]) which is generally known as the insulation breakdown withstand voltage (discharge start voltage) of discharge air. The calculation results obtained by this analysis method agreed with the results of an actually conducted experiment in which electric discharge was observed in the vicinity of the discharge electrode 4 in the ion generating apparatus 1 produced so as to fulfill the conditions shown in Table 1 and so that the line-shaped electrode of its discharge electrode 4 had an electrode portion width of 200 μm and a non-electrode portion width of 800 μm. It was also experimentally confirmed that, by reducing the duty factor of the discharge electrode 4, it was possible to reduce the amount of ozone generated.

2-4. Influence of the Thickness of the Internal Dielectric Layer

Next, an analysis will be carried out on the interrelationship between the layer thickness of the dielectric layer 3 and the electric field strength in the external space air layer in the vicinity of the surface of the ion generating apparatus 1. In the analysis will be used the electric field strength function $E_3$ of the external space air layer given by equation (11) noted earlier.

Figure 9:
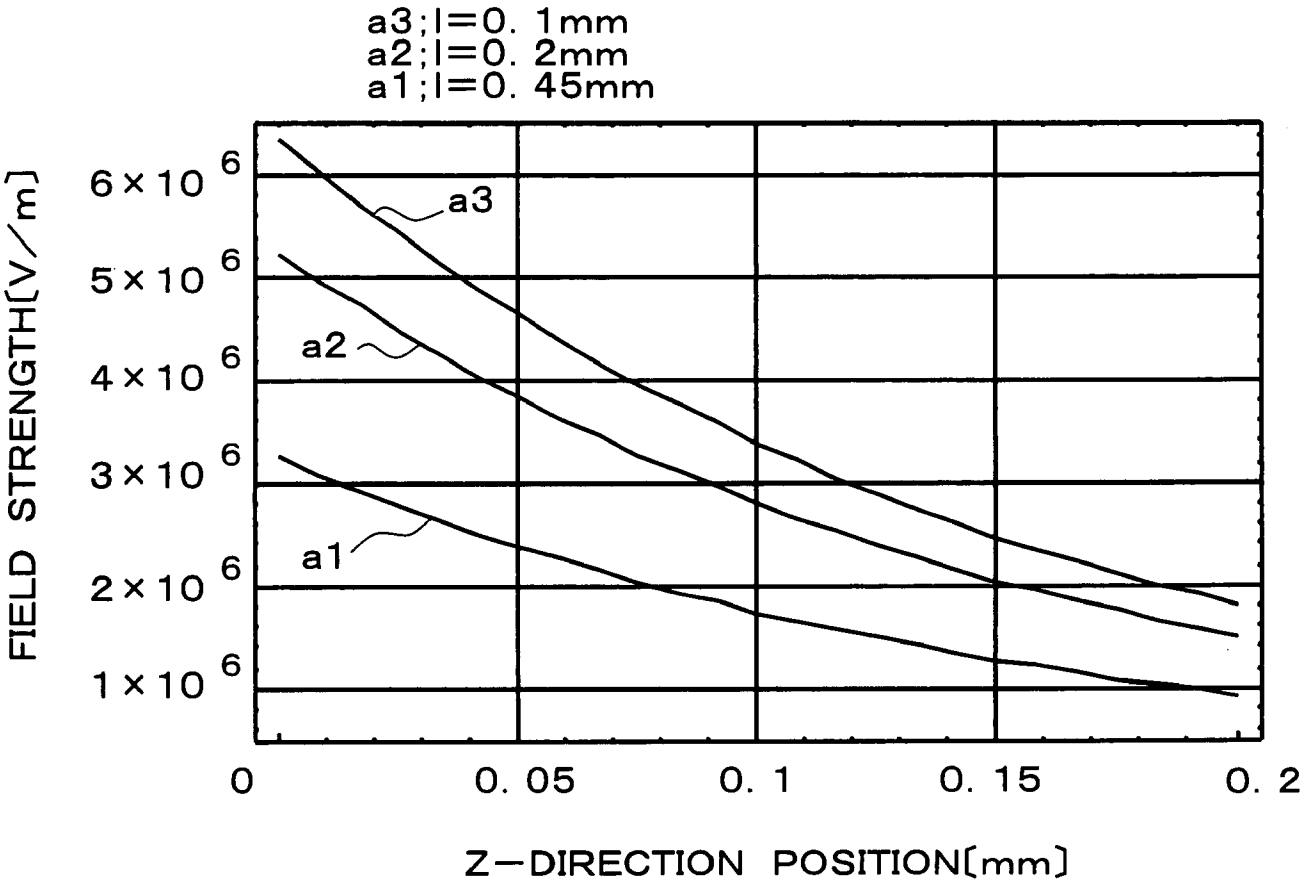
FIG. 9 is a diagram illustrating the relationship between the z-axis direction (thickness direction) position and the electric field strength with varying thicknesses of the dielectric layer of the above-mentioned ion generating apparatus.

Although the electric field strength function $E_3$ of the external space air layer is a function with respect to x and $z_3$, here, only the layer thickness l of the dielectric layer 3 is dealt with as a variable, and, in the following analysis, only the electric field strength characteristics at positions where x=0 will be examined as representative. Thus, the electric field strength function $E_3$ is now a function with respect to l and $z_3$. FIG. 9 shows the results of calculating the electric field strength with varying layer thicknesses l of the dielectric layer 3, specifically 0.45 mm (the standard value shown in Table 1), 0.2 mm, and 0.1 mm, respectively.

This figure shows that, the smaller the layer thickness of the dielectric layer 3 of the ion generating apparatus 1, the higher the electric field strength in the external space on the surface of the ion generating apparatus 1. That is, by making the dielectric layer 3 thinner, it is possible to reduce the voltage applied to the discharge electrode 4, and, by so lowering the discharge voltage, it is possible to reduce the ozone generated.

3. Structure of the Discharge Electrode of the Ion Generating Apparatus

In view of the analysis results and experiment results presented above, in this embodiment, the discharge electrode 4 of the ion generating apparatus 1 is structured in the following manner.

The plurality of line-shaped electrodes that constitute the discharge electrode 4 are laid at substantially equal intervals on the dielectric layer 3, and the pitch (period) with which the line-shaped electrodes are laid one adjacent to the next is substantially constant (for example, 1 mm). In this case, the electric charge density of the discharge electrode 4 varies periodically in the direction in which the line-shaped electrodes are laid one adjacent to the next. This can be said to indicate that the discharge electrode 4 has a periodicity such that the electric charge density varies periodically in the direction in which the line-shaped electrodes are laid one adjacent to the next.

Moreover, the discharge electrode 4 is formed in such a way that, within a single pitch of the line-shaped electrodes, the electrode portion width of the line-shaped electrodes is smaller than the non-electrode portion width thereof. Here, the electrode portion width denotes the width of each of the line-shaped electrodes as measured in the direction in which they are laid one adjacent to the next, and the non-electrode portion width denotes, within a single pitch of the line-shaped electrodes, the width of the region where the line-shaped electrodes are not formed as measured in the direction in which they are laid one adjacent to the next. For example, in this embodiment, the electrode portion width of each of the line-shaped electrodes of the discharge electrode 4 is 200 μm, and the non-electrode potion width thereof is 800 μm. Thus, within a single pitch of the line-shaped electrodes, the area of the electrode portion of the line-shaped electrodes is smaller than the area of the non-electrode portion thereof By forming the discharge electrode 4, with the pattern described above, on the dielectric layer 3, it is possible to make the electric field concentrate more on the line-shaped electrodes of the discharge electrode 4 and thereby obtain a higher electric field intensity than in a structure in which the discharge electrode 4 is formed in such a way that the area of the electrode portion is equal to the area of the non-electrode portion. Thus, by concentrating the electric field more on the line-shaped electrode, it is possible to reduce the amount of ozone generated during electric discharge.

Moreover, since the discharge electrode 4 patterned as described above yields a higher electric field strength, it can be said that it is now possible to cause electric discharge easily even with a lower discharge voltage. This makes it possible to lower the discharge voltage, and thus also contributes to the reduction of the amount of ozone generated during electric discharge.

That is, by giving the discharge electrode 4 the pattern described above, it is possible to doubly achieve the reduction of the amount of ozone generated, i.e., both through the concentration of the electric field and through the reduction of the discharge voltage.

4. Thinning of the Dielectric Layer of the Ion Generating Apparatus

From the analysis results and experiment results presented earlier, it is now found that thinning the dielectric layer 3 helps to lower the discharge voltage and thereby reduce the amount of ozone generated. However, the dielectric layer 3 cannot be made thinner beyond a certain limit because of insulation breakdown.

For example, in a case where the dielectric layer 3 is formed as a layer of anodized aluminum (a porous coating), it is generally given a thickness of several μm to several ten μm. It has been experimentally found that a film having a thickness of 30 μm usually requires an insulation breakdown withstand voltage of 30 V/μm, although it depends on the type of the electrolyte used to form the porous coating, the method of stopping the pores in the porous coating, the type of aluminum used, the film thickness of the coating, and other factors. Accordingly, to make the dielectric layer 3 thinner than it is when formed as a layer of anodized aluminum, it is necessary to use a material with a higher insulation breakdown withstand voltage. Examples of such materials having high insulation breakdown withstand voltages include, to name a few, $Ta_2O_3$ film, $Ta_2O_5$—$Al_2O_3$ composite film, and $SrTiO_3$ thin film.

Incidentally, $Ta_2O_3$ film, and also $Ta_2O_5$—$Al_2O_3$ composite film formed by reactive sputtering, has an insulation breakdown withstand voltage of 100 V/μm. $SrTiO_3$ thin film formed by magnetron sputtering has an insulation breakdown withstand voltage of 200 V/μm.

By forming the dielectric layer 3 as an insulating film containing at least one element selected from titanium, tantalum, and strontium, of which any has a high insulation breakdown withstand voltage, in this way, it is possible to realize an insulation breakdown withstand voltage of 30 V/μm or more relatively easily. This makes it possible to make the dielectric layer 3 still thinner than it is when formed of a layer of anodized aluminum, while preventing the insulation breakdown of the dielectric layer 3. By making the dielectric layer 3 thinner in this way, it is possible to increase the electric field intensity in the external space on the surface of the ion generating apparatus 1 as described earlier. Thus, it is possible to further lower the voltage applied to the discharge electrode 4 and thereby further reduce the amount of ozone generated.

That is, by forming the dielectric layer 3 as an insulating film containing at least one element selected from titanium, tantalum, and strontium, of which any has a high insulation breakdown withstand voltage, it is possible to realize easily and surely a thin film having an insulation breakdown withstand voltage of 30 V/μm or more and having a thickness of 30 μm or less. By making the dielectric layer 3 thinner in this way, it is possible to reduce the amount of zone generated during electric discharge while surely preventing the insulation breakdown of the dielectric layer 3.

Moreover, with the discharge voltage lowered, it is no longer necessary to use a large power supply as the power supply 6. This helps to make the ion generating apparatus 1 compact.

5. Practical Example

Figure 10:
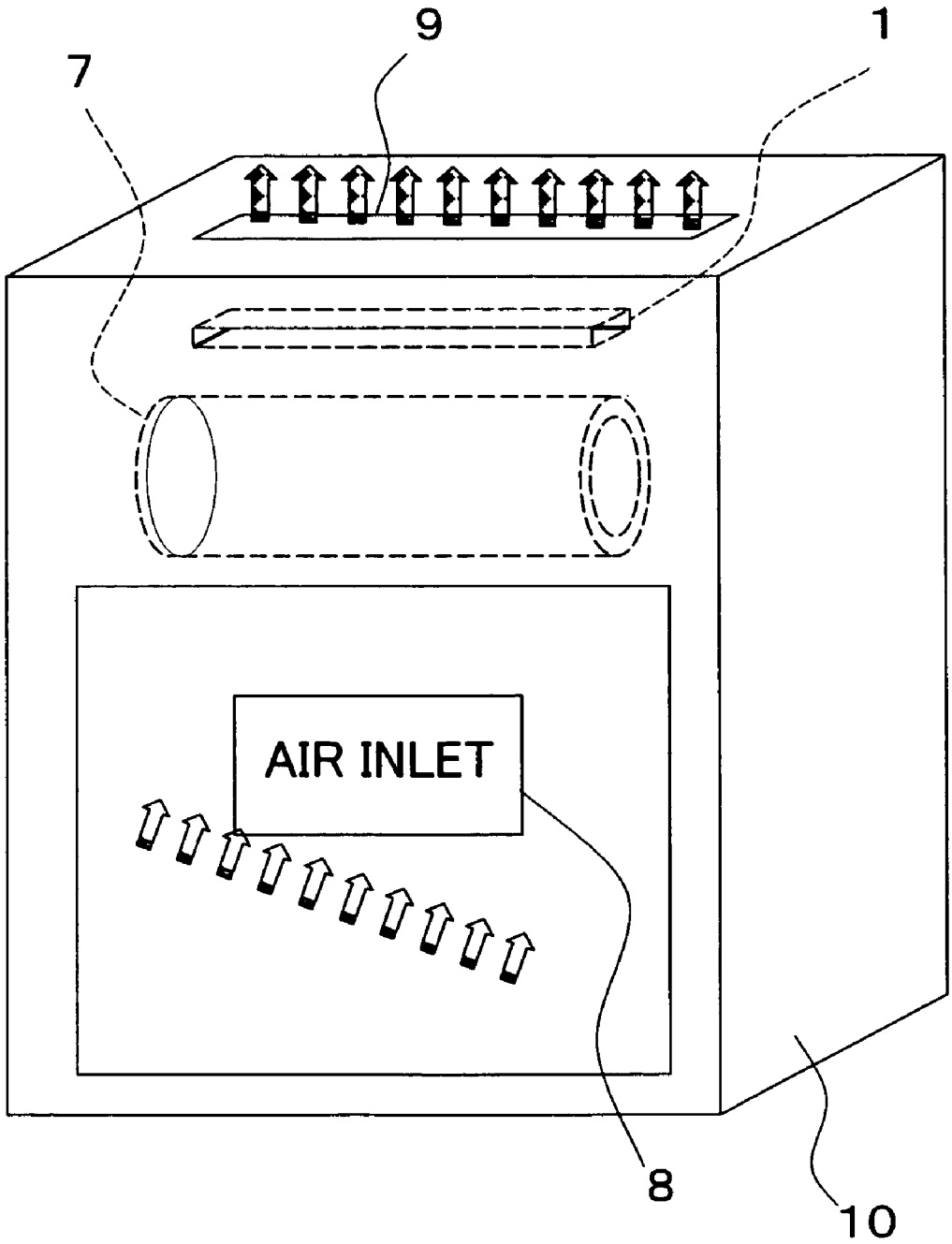
FIG. 10 is a diagram illustrating an outline of the structure of an air conditioning apparatus provided with the above-mentioned ion generating apparatus.

The ion generating apparatus 1 of the embodiment described above finds application, for example, in air conditioning apparatuses such as air purifiers and air conditioners. FIG. 10 is a diagram illustrating an outline of the structure of an air conditioning apparatus incorporating the ion generating apparatus 1 according to the invention. This air conditioning apparatus has, in addition to the ion generating apparatus 1 described above, a blower 7, an air inlet 8, and an air outlet 9 provided in a body 10. The blower 7 is for feeding air from outside the apparatus to the ion generating apparatus 1 and for discharging the positive and negative ions generated by the ion generating apparatus 1 to outside the apparatus. The blower 7 is realized, for example, with a motor or fan.

When the blower 7 is driven, air outside the apparatus is sucked through the air inlet 8 into the body 10, and is fed to the ion generating apparatus 1. The ion generating apparatus 1 generates positive and negative ions by causing corona discharge, and these positive and negative ions are discharged through the air outlet 9 out into the atmosphere outside the apparatus. This permits airborne bacteria present in the atmosphere to be killed and deactivated by the positive and negative ions, and thereby achieves air purification.

Figure 11:
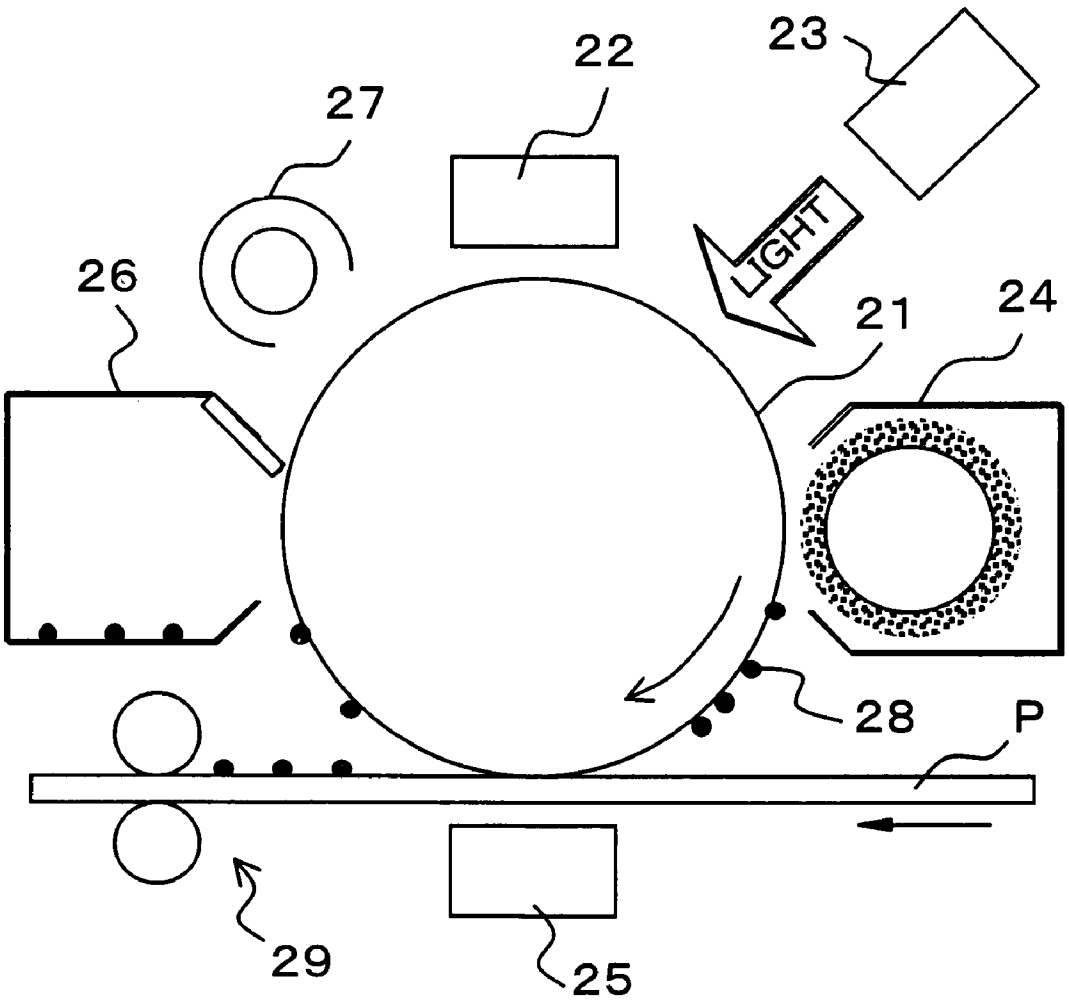
FIG. 11 is a diagram illustrating an outline of the structure of an image formation apparatus provided with the above-mentioned ion generating apparatus as a charging apparatus.

The ion generating apparatus 1 described as an embodiment above can also be used as a charging apparatus in an image formation apparatus. FIG. 11 is a diagram illustrating an outline of the structure of an image formation apparatus incorporating, as a charging apparatus, the ion generating apparatus 1 according to the invention.

This image formation apparatus is provided with a photoconductive member 21 and an image formation processor (apparatus) composed of various kinds of devices. The photoconductive member 21 functions as an electrostatic latent image carrier for carrying an electrostatic latent image. The photoconductive member 21 is shaped like a drum that is driven to rotate at a constant speed in the direction indicated by an arrow in the figure during an operation for forming an image, and is arranged substantially in a central part of the body of the image formation apparatus.

The image formation processor mentioned above is provided with various kinds of devices such as a charger 22, an optical system 23, a developing device 24, a transfer device 25, a cleaning device 26, and a neutralizer 27. These devices are arranged around the circumference of the photoconductive member 21 so as to face it, in the order named in the direction of the rotation of the photoconductive member 21.

The charger 22 is for uniformly charging the surface of the photoconductive member 21. The optical system 23 exposes the photoconductive member 21 to light by irradiating the surface thereof with light according to image data so that an electrostatic latent image according to the image data is formed on the surface of the photoconductive member 21.

More specifically, in a case where the image formation apparatus is a digital copier or printer, the optical system 23 irradiates the photoconductive member 21 with an optical image formed by turning on and off a semiconductor laser according to image data. In particular in a digital copier, image data obtained by reading with an image reading sensor (such as a CCD) the light reflected from an original document is fed to the optical system 23 including the above-mentioned semiconductor laser so that the optical system 23 outputs an optical image according to the image data. On the other hand, in a printer, image data outputted from another processing apparatus (for example, a word processor or personal computer) is converted into an optical image corresponding to the image data, and this optical image is shone from the optical system 23 onto the photoconductive member 21. The optical image may be shone onto the photoconductive member 21 by the use of, instead of the semiconductor laser, an LED device or a liquid crystal shutter.

The developing device 24 makes the electrostatic latent image formed on the surface of the photoconductive member 21 through the exposure of the optical system 23 visible by using toner 28, i.e., particles for making a latent image visible. In this embodiment, the toner 28 is, for example, a one-component toner, and the development of the image is achieved as a result of the toner 28 being selectively attracted by, for example, the electrostatic power exerted by the electrostatic latent image formed on the surface of the photoconductive member 21.

The transfer device 25 transfers the toner image developed by the developing device 24 onto a sheet of paper P that is transported with appropriate timing. After the transfer of the toner image onto the paper P, the cleaning device 26 removes the developer (toner 28) that remains on the surface of the photoconductive member 21 without being transferred onto the paper P. The neutralizer 27 neutralizes the electric charge that remains on the surface of the photoconductive member 21.

The above-mentioned image formation processor is further provided with a fixing device 29 in a paper exit side of the body of the image formation apparatus. The fixing device 29 fixes the unfixed toner image transferred onto the paper P by the transfer device 25 so that the image is fixed as a permanent image on the paper P.

The fixing device 29 has a heat roller and a pressure roller. The part of the surface of the heat roller that faces the paper P (toner image) is heated to a temperature at which the toner 28 is fused and fixed on the paper P. The pressure roller presses the paper P against the heat roller so that the paper P is kept in intimate contact with the heat roller. After passing through the fixing device 29, the paper P is transported out of the image formation apparatus through an eject roller (not illustrated), and is ejected into an eject tray (not illustrated).

In this image formation apparatus, when an image formation operation is started, the photoconductive member 21 is driven to rotate in the direction indicated by the arrow in the figure, and the surface of the photoconductive member 21 is charged with a potential of a predetermined polarity by the charger 22. After this charging, the photoconductive member 21 is irradiated with an optical image according to imager data by the optical system 23, so that an electrostatic latent image according to the optical image is formed on the surface of the photoconductive member 21. In a region of the photoconductive member 21 facing the developing device 24, the thus formed electrostatic latent image is developed with the toner 28. Thereafter, as the photoconductive member 21 rotates, the toner image is transported to a region thereof facing the transfer device 25.

On the other hand, a number of sheets of paper P are stocked, for example, in a tray or cassette, and these are fed, one by one and with predetermined timing, into a region (transfer region) between the transfer device 25 and the photoconductive member 21 by a paper feeder (not illustrated). Here, the predetermined timing is such that the head end of the toner image formed on the surface of the photoconductive member 21 coincides with the head end of a sheet of paper P.

The toner image on the surface of the photoconductive member 21 is electrostatically transferred by the transfer device 25 onto the paper P that is transported in synchronism with the rotation of the photoconductive member 21 as described above. Here, the transfer device 25 charges the back face of the paper P with the polarity opposite to that with which the toner 28 is charged. This causes the toner image to be transferred onto the paper P. After having the toner image transferred thereon, the paper P is separated from the photoconductive member 21 by separating claws (not illustrated), and is then fed into the fixing device 29.

In the fixing device 29, the toner image on the paper P is fused by the heat roller, and is, by the pressure between the heat roller and the pressure roller, pressed onto and thereby fused onto the paper P. Having passed through the fixing device 29, the paper P, as a sheet of paper P having an image already formed thereon, is ejected into an eject tray or the like provided outside the image formation apparatus.

On the other hand, after the transfer of the toner image onto the paper P, part of the toner image that has not been transferred onto the paper P remains on the surface of the photoconductive member 21. This residual toner is removed from the surface of the photoconductive member 21 by the cleaning device 26. Then, the neutralizer 27 neutralizes the electric charge on the surface of the photoconductive member 21 to a uniform potential (for example, to substantially zero potential) to make the surface of the photoconductive member 21 ready for the next image formation operation.

It is possible to use the ion generating apparatus 1 according to the invention as a charging apparatus in the charger 22 or the neutralizer 27 in an image formation apparatus as described above that operates on the principle of electrophotography. Here, a charging apparatus denotes an apparatus, like the charger 22 and the neutralizer 27, for feeding electric charge (for neutralization, electric charge of the opposite polarity) onto the photoconductive member 21. When the ion generating apparatus 1 according to the invention is used as a charging apparatus in an image formation apparatus, the electric charge that takes place in the ion generating apparatus 1 permits electric charge to be fed onto the photoconductive member 21. This makes it possible to realize the charger 22 and the neutralizer 27 easily. Moreover, this helps to realize an image formation apparatus that generates a greatly reduced amount of ozone as compared with a conventional charger such as one adopting a wire charger method whereby a high voltage is applied to a tungsten wire of a diameter of about 60 μm.

As described above, in the ion generating apparatus 1 according to the invention, the lower discharge voltage and the thinner dielectric layer 3 lead to a reduced amount of ozone generated. Thus, by using such an ion generating apparatus 1 in an air conditioning apparatus or charging apparatus, it is possible to realize an air conditioning apparatus or charging apparatus that is friendly to the human body and to the environment.

In an air conditioning apparatus according to the invention, there is no need to use an ozone concentration detecting sensor and a controller for controlling the voltage applied to the discharge electrode as are conventionally required. In a charging apparatus according to the invention, there is no need to use an ozone-eliminating filter as is conventionally required. This helps to make such apparatuses compact, to make the needed power supply compact, and to reduce the costs.

Obviously, many modifications and variations of the present invention are possible in light of the above teachings. It is therefore to be understood that within the scope of the appended claims, the invention may be practiced other than as specifically described.

What is claimed is:

1. An ion generating apparatus that includes a dielectric layer sandwiched between an induction electrode and a discharge electrode and that generates both positive and negative ions by applying an alternating voltage between the induction electrode and the discharge electrode to cause electric discharge, wherein the induction electrode is formed of a metal substrate and is thicker than the dielectric layer.

2. The ion generating apparatus according to claim 1, wherein the induction electrode is 1 mm or more thick.

3. The ion generating apparatus according to claim 1, wherein the metal substrate is made of aluminum, and wherein the dielectric layer is formed of a an anodic oxide film of the aluminum.

4. The ion generating apparatus according to claim 3, wherein the discharge electrode is formed as a metal electrode containing at least one metal selected from the group consisting of nickel, cobalt, and copper.

5. The ion generating apparatus according to claim 1, wherein the discharge electrode is formed as a plurality of line-shaped electrodes laid in stripes on the dielectric layer in such a way that, within a single pitch with which the line-shaped electrodes are laid one adjacent to a next, an area occupied by an electrode portion of the line-shaped electrode laid there is smaller than an area occupied by a non-electrode portion thereof.

6. The ion generating apparatus according to claim 1, further including:

a surface coat layer formed on the dielectric layer so as to cover the discharge electrode.

7. The ion generating apparatus according to claim 6, wherein the surface coat layer is formed of a thin-film dielectric material having a film thickness of 15 μm or less.

8. The ion generating apparatus according to claim 6, wherein the surface coat layer is formed of an oxide film or a nitride film.

9. An ion generating apparatus that includes a dielectric layer sandwiched between an induction electrode and a discharge electrode and that generates both positive and negative ions by applying an alternating voltage between the induction electrode and the discharge electrode to cause electric discharge, wherein the induction electrode is formed of a metal substrate and, wherein the dielectric layer is formed of a thin film having an insulation breakdown withstand voltage of 30 V/μm or more and having a thickness of 30 μm or less.

10. An ion generating apparatus that includes a dielectric layer sandwiched between an induction electrode and a discharge electrode and that generates both positive and negative ions by applying an alternating voltage between the induction electrode and the discharge electrode to cause electric discharge, wherein the induction electrode is formed of a metal substrate and, wherein the dielectric layer is formed of an insulating film containing at least one element selected from the group consisting of titanium, tantalum, and strontium.

11. An air conditioning apparatus including:

an ion generating apparatus that includes a dielectric layer sandwiched between an induction electrode and a discharge electrode and that generates both positive and negative ions by applying an alternating voltage between the induction electrode and the discharge electrode to cause electric discharge, the induction electrode being formed of a metal substrate and being thicker than the dielectric layer; and a blower that blows the positive and negative ions generated by the ion generating apparatus out of the air conditioning apparatus.

12. A charging apparatus including:

an ion generating apparatus that includes a dielectric layer sandwiched between an induction electrode and a discharge electrode and that generates both positive and negative ions by applying an alternating voltage between the induction electrode and the discharge electrode to cause electric discharge, the induction electrode being formed of a metal substrate and being thicker than the dielectric layer, wherein the charging apparatus uses electric discharge occurring in the ion generating apparatus in order to feed electric charge onto an electrostatic latent image carrying member.

* * * * *